US009784074B1

(12) United States Patent
Hellums et al.

(10) Patent No.: US 9,784,074 B1
(45) Date of Patent: Oct. 10, 2017

(54) EXTENDER JUMPER SYSTEM AND METHOD

(71) Applicant: ONESUBSEA IP UK LIMITED, London (GB)

(72) Inventors: John Hellums, Houston, TX (US); David Anthony James, Lufkin, TX (US); Jesus Manuel Williams Sequera, Houston, TX (US); Ted Mercer, Cypress, TX (US); Randy Kimberling, Houston, TX (US); Ken Flakes, Houston, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 15/280,832

(22) Filed: Sep. 29, 2016

(51) Int. Cl.

| | |
|---|---|
| ***E21B 41/00*** | (2006.01) |
| ***E21B 43/013*** | (2006.01) |
| ***E21B 43/017*** | (2006.01) |
| ***E21B 19/00*** | (2006.01) |

(52) U.S. Cl.
CPC ..... *E21B 41/0007* (2013.01); *E21B 19/002* (2013.01); *E21B 43/013* (2013.01); *E21B 43/017* (2013.01)

(58) Field of Classification Search
CPC .. E21B 19/002; E21B 41/0007; E21B 43/013; E21B 43/017
See application file for complete search history.

(56) References Cited

U.S. PATENT DOCUMENTS

| | | | | |
|---|---|---|---|---|
| 4,472,080 | A * | 9/1984 | Lawson | E21B 43/0135 166/347 |
| 4,693,636 | A * | 9/1987 | Fraser, Jr. | F16L 1/26 166/347 |
| 4,842,075 | A * | 6/1989 | Kalvenes | F16L 1/26 166/341 |
| 5,163,782 | A * | 11/1992 | Paulo | F16L 37/002 166/360 |
| 5,195,589 | A * | 3/1993 | Mota | F16L 37/002 166/341 |
| 5,244,045 | A * | 9/1993 | Mota | E21B 43/013 166/341 |
| 6,340,057 | B1 * | 1/2002 | Dantas | E21B 43/017 166/337 |
| 6,793,019 | B2 * | 9/2004 | Rodgers | F16L 1/26 166/340 |
| 6,902,199 | B2 * | 6/2005 | Colyer | E21B 33/038 285/29 |
| 7,063,485 | B2 * | 6/2006 | Jordan | E21B 19/004 405/169 |
| 7,794,177 | B2 * | 9/2010 | DeLack | E21B 41/04 405/169 |
| 8,096,364 | B2 * | 1/2012 | Dursley | E21B 19/002 166/338 |

(Continued)

*Primary Examiner* — Matthew R Buck
(74) *Attorney, Agent, or Firm* — Fletcher Yoder, P.C.

(57) ABSTRACT

Extender jumper systems and methods including an extender jumper system having an extender jumper assembly with a flowline and first and second connectors positioned at first and second ends of the flowline, and a support assembly configured to couple the extender jumper assembly to a support structure within a subsea field and to support the second connector to facilitate attachment between the second connector and a corresponding connector of another extender jumper or a jumper.

21 Claims, 5 Drawing Sheets

(56) References Cited

U.S. PATENT DOCUMENTS

| | | | | |
|---|---|---|---|---|
| 8,235,121 | B2 * | 8/2012 | Williams | E21B 43/0107 166/338 |
| 8,425,154 | B1 * | 4/2013 | Lugo | F16L 1/26 166/347 |
| 2010/0018693 | A1 * | 1/2010 | Duncan | E21B 23/08 166/77.2 |

* cited by examiner

EXTENDER JUMPER SYSTEM AND METHOD

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Drilling and production systems are typically employed to access, extract, and otherwise harvest desired natural resources, such as oil and gas, that are located below the surface of the earth. These systems may be located onshore or offshore depending on the location of the desired natural resource. When a natural resource is located offshore (e.g., below a body of water), a subsea production system may be used to extract the natural resource. Such subsea production systems may include components located on a surface vessel (e.g., a rig or platform), components located remotely from the surface vessel at a subsea location, typically on or near the seabed or seafloor at or near an access conduit to a subterranean formation (e.g., a well) in which the resource is located, and/or components between subsea and surface. Subsea production systems may include jumpers to convey fluids to or between various components of the subsea production systems.

BRIEF DESCRIPTION OF THE DRAWINGS

Embodiments of an extender jumper system and method are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION OF SPECIFIC EMBODIMENTS

Figure 1:
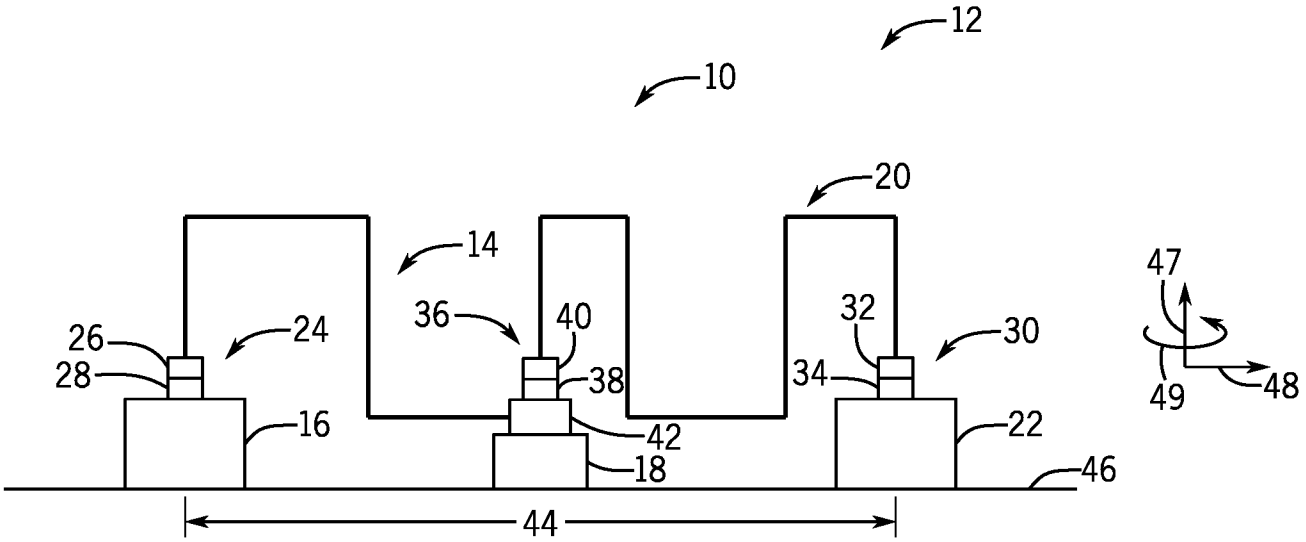
FIG. 1 is a schematic diagram of an extender jumper system within a subsea field, in accordance with one or more embodiments of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are used in an open-ended fashion, and thus should be interpreted to mean "including, but not limited to . . . ." Also, any use of any form of the terms "connect," "engage," "couple," "attach," "mate," "mount," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" or "lateral" or "laterally" generally mean perpendicular to the central axis. For instance, an axial distance refers to a distance measured along or parallel to the central axis, and a radial distance means a distance measured perpendicular to the central axis. The use of "top," "bottom," "above," "below," "upper," "lower," "up," "down," "vertical," "horizontal," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function.

As noted above, certain subsea production systems may utilize jumpers to convey fluids to or between various components of a subsea production system. The length of some typical jumpers or the distance spanned by some typical jumpers may be limited to achieve acceptable stability of the jumper and/or fluid flow through the jumper, for example. With the foregoing in mind, embodiments of the present disclosure relate generally to extender jumper systems configured to fluidly connect two or more components of a subsea production system to one another. In certain embodiments, an extender jumper system includes an extender jumper having a first connector (e.g., collet connector or female connector) at a first end to couple the extender jumper to a first component within a subsea field and a second connector (e.g., hub or male connector) at a second end to couple the extender jumper to another jumper (e.g., another extender jumper or other type of jumper or flowline). The extender jumper may include a support assembly at the second end to couple the extender jumper to a support structure positioned within a subsea field and/or to support the second connector to facilitate coupling the extender jumper to another jumper. Thus, the extender jumper may enable multiple jumpers to be coupled to one another to span a distance between two components of the subsea field. As discussed in more detail below, the support assembly of the extender jumper may be supported by and/or coupled to various support structures within the subsea field, including a wellhead (e.g., abandoned wellhead) or other existing structure installed at and/or fixed to the sea floor, for example. While it is envisioned that an extender jumper system of the present disclosure may be connected to a specially installed support structure, use of an existing structure may provide a rigid attachment point for the extender jumper system without additional costs and/or time delays associated with constructing or installing a new platform or support structure.

FIG. 1 is a schematic diagram of an extender jumper system 10 within a subsea field 12, in accordance with embodiments of the present disclosure. As shown, the extender jumper system 10 includes an extender jumper 14 (e.g., extender jumper assembly, extender tubular assembly, extender flowline assembly, or extender flexible pipe assembly) that extends between a first structure 16 (e.g., first host structure or first component) and a support structure 18. As shown, a jumper 20 (e.g., jumper assembly, tubular assembly, flowline assembly, or flexible pipe assembly) may extend from the extender jumper 14 at the support structure 18 to a second structure 22 (e.g., second host structure or second component). Thus, the extender jumper system 10 may enable fluid connection between the first structure 16 and the second structure 22 that are separated from one another by a distance 44, which may exceed an acceptable distance for a single jumper 20 or other typical jumpers, pipelines, or connectors, for example.

The first structure 16 and the second structure 22 may be any of a variety of subsea structures, including, but not limited to, a manifold, a Christmas tree, a pipeline end termination (PLET), a pipeline end manifold (PLEM), a pump (e.g., multiphase pump), or a high integrity pressure protection system (HIPPS). Similarly, the support structure 18 may be any of a variety of subsea structures, including, but not limited to, a manifold, a Christmas tree, a PLET, a PLEM, a pump, a HIPPS, a wellhead, a mud mat, a pile, a skid, or any other subsea equipment, component, or platform capable of support, any of which may be existing (e.g., previously installed at or near and/or fixed to the sea floor for use in drilling or production or injection or intervention operations, for example), currently operative, previously operative, currently inoperative, and/or abandoned (e.g., indefinitely inoperative, plugged, and/or incapable of operating for its original intended purpose in its current state). For example, the support structure 18 may include an inoperative wellhead, such as an abandoned wellhead. Furthermore, the first structure 16, the second structure 22, and the support structure 18 may be the same type of subsea structure or different types of subsea structures.

In the illustrated embodiment, the extender jumper 14 and the first structure 16 are coupled to one another at an interface 24, which may include a connector 26 (e.g., first connector) configured to couple to a connector 28 (e.g., second connector). In some embodiments, the connector 26 is a female connector (e.g., collet connector) positioned at one end of the extender jumper 14, and the connector 28 is a male connector extending from the first structure 16. In the illustrated embodiment, the jumper 20 and the second structure 22 are coupled to one another at an interface 30, which may include a connector 32 (e.g., third connector) configured to couple to a connector 34 (e.g., fourth connector). In some embodiments, the connector 32 is a female connector (e.g., collet connector) positioned at one end of the jumper 20, and the connector 34 is a male connector extending from the second structure 22. In the illustrated embodiment, the extender jumper 14 and the jumper 20 may be coupled to one another at an interface 36, which may include a connector 38 (e.g., fifth connector) and a connector 40 (e.g., sixth connector) configured to couple to one another. In some embodiments, the connector 38 is a male connector positioned at one end of the extender jumper 14, and the connector 40 is a female connector (e.g., collet connector) positioned at one end of the jumper 20. As discussed in more detail below, the extender jumper 14 may include a support assembly 42 (e.g., annular support assembly) that facilitates connection between the extender jumper 14 and the jumper 20 (e.g., by supporting the connector 38) and/or that couples the extender jumper 14 to the support structure 18. It should be understood that any of the connectors 26, 28, 32, 34, 38, and 40 may be male or female connectors, and may be coupled to a corresponding male or female connector. The connectors 26, 28, 32, 34, 38, 40 may be any of a variety of types of connectors, including clamp connectors, collet connectors, split ring connectors, flanges (including bolted flanges), threaded connectors, or the like. The connectors 26, 28, 32, 34, 38, 40 also may include locking dogs, lock rings, toothed interfaces, tongue-in-groove interfaces, threaded interfaces, or any combination thereof.

As noted above, some typical jumpers may be limited in length, and a single jumper may not be able to span the distance 44 between two components (e.g., the first structure 16 and the second structure 22) positioned at a sea floor 46 within the subsea field 12. The extender jumper 14 enables multiple jumpers (e.g., one or more extender jumpers 14 and the jumper 20) to be coupled to one another in series to span the distance 44 between the two components. For example, the extender jumper 14 may include various features, such as the support assembly 42 and the connector 38, which support the extender jumper 14 above the sea floor 46 and enable the extender jumper 14 to couple to another jumper (e.g., another extender jumper 14 or the jumper 20), respectively, thereby enabling the extender jumper system 10 to span the distance 44 between the two components. In some embodiments, the support assembly 42 may stabilize the extender jumper system 10, thereby facilitating fluid flow between the two components and/or reducing wear (e.g., at the connectors 26, 28, 38, 40, 32, 34), for example.

As noted above, the support structure 18 may be any of a variety of subsea structures. However, in some embodiments, an abandoned subsea structure (e.g., abandoned wellhead) may be used as the support structure 18, and the support assembly 42 of the extender jumper 14 may be coupled to the abandoned subsea structure (e.g., to an accessible or exposed structure, such as a housing of the abandoned wellhead). Such abandoned subsea structures may be fixed and/or cemented in place at the sea floor 46 and may provide a stable support structure 18 for the extender jumper 14 without additional time and/or costs associated with manufacturing and/or installing for the specific purpose other types of support structures, such as mud mats, piles, or the like.

The extender jumper system 10 disclosed herein may be utilized in a variety of circumstances. For example, in some cases, such as when an existing well at a first location within the subsea field 12 is no longer producing, it may be desirable to drill a new well at another location (e.g. re-spud location) within the subsea field 12. In some such cases, a distance between the re-spud location and existing structures (e.g., the first structure 16, a manifold, a pump, a PLET, a PLEM, and/or a HIPPS) within the subsea field 12 may exceed preferred or acceptable distances for typical jumpers or other typical pipelines or connectors. However, the extender jumper system 10 may be utilized to fluidly connect such existing structures to a new production tree (e.g., the second structure 22) positioned at the new well at the re-spud location. In some such embodiments, a wellhead (e.g., an abandoned wellhead) at the existing well (e.g., a plugged well) at the first location within the subsea field 12 may be utilized as the support structure 18 to enable the extender jumper system 10 to span the distance between the production tree at the new well at the re-spud location and the existing manifold or other existing structures, for example. To facilitate discussion, the extender jumper system 10 and its components may be described with reference to an axial axis or direction 47, a radial or a lateral axis or direction 48, and a circumferential axis or direction 49.

Figure 2:
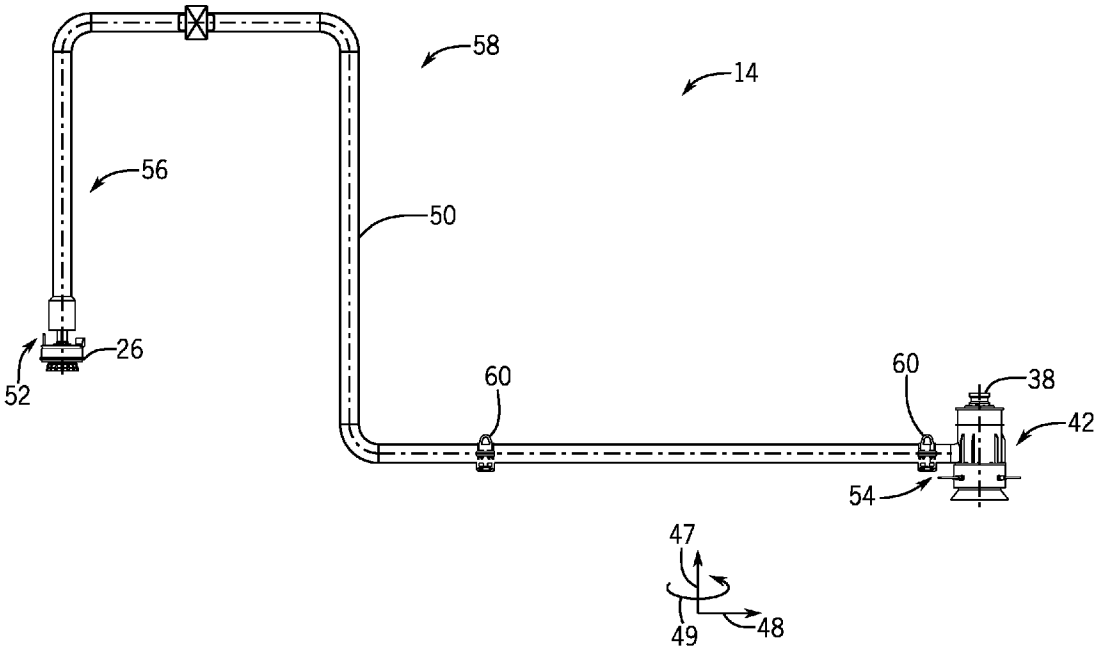
FIG. 2 is a side view of an extender jumper that may be used in the extender jumper system of FIG. 1, in accordance with one or more embodiments of the present disclosure.

FIG. 2 is a side view of an embodiment of the extender jumper 14 that may be used in the extender jumper system 10 of FIG. 1. As shown, the extender jumper 14 includes a pipe 50 (e.g., tube or flowline) to support fluid flow, the connector 26 positioned at a first end 52 of the extender jumper 14, and the connector 38 positioned at a second end 54 of the extender jumper 14. In the illustrated embodiment, the connector 26 is a female collet connector that is configured to couple to a corresponding male connector, such as the connector 28 of the first structure 16 or the connector 38 of another extender jumper 14 shown in FIG. 1. However, in other embodiments, the connector 26 may be a male connector that is configured to couple to a corresponding female connector, such as the connector 28 of the first structure 16 or the connector 38 of another extender jumper 14 shown in FIG. 1 In the illustrated embodiment, the connector 38 is a male connector that is configured to couple to a corresponding female connector, such as the connector 40 of the jumper 20 or the connector 26 of another extender jumper 14 shown in FIG. 1. However, in other embodiments, the connector 38 may be a female connector that is configured to couple to a corresponding male connector, such as the connector 40 of the jumper 20 or the connector 26 of another extender jumper 14 shown in FIG. 1. As noted above, the connectors 26, 38, as well as other connectors 28, 32, 34, 40 described herein, may include locking dogs, lock rings, toothed interfaces, tongue-in-groove interfaces, threaded interfaces, or any combination thereof. As shown, the connector 38 is supported by the support assembly 42, which is configured to mount to the support structure 18 (e.g., abandoned wellhead).

Figure 3:
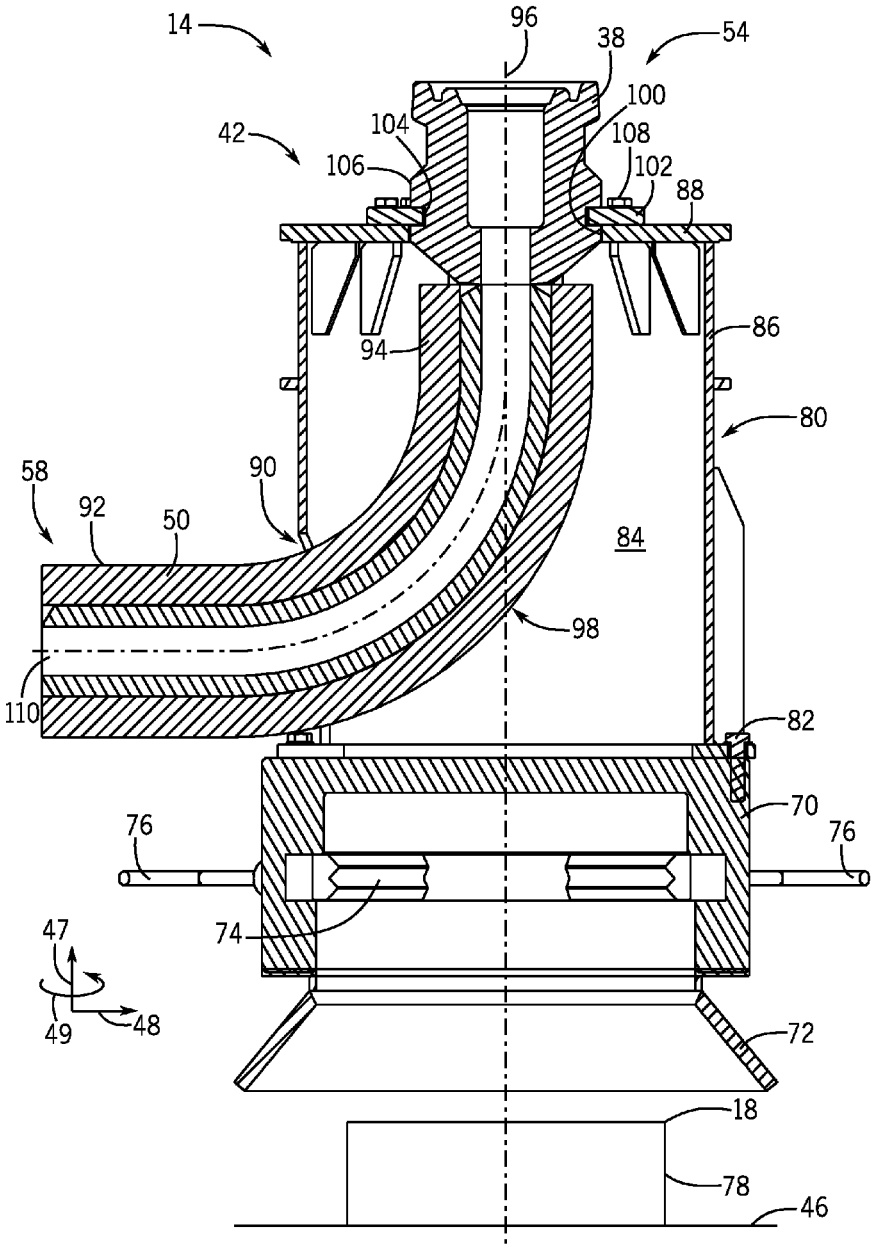
FIG. 3 is a cross-sectional side view of a support assembly of the extender jumper of FIG. 2, in accordance with one or more embodiments of the present disclosure.

The pipe 50 may have any of a variety of configurations to support fluid flow. The pipe 50 generally extends between the connector 26 and the connector 38 to enable fluid flow between the first end 52 and the second end 54 of the extender jumper 14. In some embodiments, the pipe 50 includes sections that extend in different directions, which may enable the connector 26 and/or the connector 38 to face or be oriented axially upward or axially downward, which may in turn facilitate connection with corresponding connectors of other extender jumpers 14, the jumper 20, and/or structures 16, 22. For example, in the illustrated embodiment, the pipe 50 includes a first axially extending portion 56 that is aligned with (e.g., coaxial) and extends axially from the connector 26. As shown in FIG. 3 and discussed in more detail below with respect to FIG. 3, the pipe 50 may also include a second axially extending portion 94 that is aligned with (e.g., coaxial) and extends axially from the connector 38 within the support assembly 42, and a bending portion 58 (e.g., having segments extending in different directions, such as in directions 47 and 48) that connects the first axially extending portion 56 and the second axially extending portion 94. As shown, the extender jumper 14 may include clamps 60 to facilitate moving the extender jumper 14 between the sea surface and the subsea field 12, for example.

FIG. 3 is a cross-sectional side view of an embodiment of the support assembly 42 of the extender jumper 14 of FIG. 2. The support assembly 42 is configured to support the connector 38 and to couple to the support structure 18, such as a manifold, a Christmas tree, a PLET, a PLEM, a pump, a HIPPS, a wellhead, a mud mat, a pile, a skid, or any other subsea equipment, component, or platform capable of support, any of which may be existing, currently operative, previously operative, currently inoperative, active, inactive, and/or abandoned. For example, the support structure 18 may include an inoperative wellhead, such as an abandoned wellhead. In the illustrated embodiment, the support assembly 42 includes a hollow housing or cap 70 (e.g., annular cap, sleeve, or cup) configured to receive and to circumferentially surround at least a portion of the support structure 18. In some embodiments, a capture funnel 72 (e.g., tapered annular funnel or frustroconical funnel) may extend axially from the cap 70 to guide the cap 70 into position about the support structure 18. In some embodiments, the cap 70 may have a circular cross-sectional shape (e.g., taken in a plane perpendicular to the axis 47) to facilitate coupling the support assembly 42 to a housing (e.g., high pressure housing) of an abandoned wellhead, for example; however, it should be understood that the cap 70 may have any of a variety of suitable geometries and cross-sectional shapes, including a rectangular cross-sectional shape, to facilitate coupling the support assembly 42 to various support structures 18. The cap 70 is configured to block lateral movement (e.g., horizontal movement) of the extender jumper 14 along the sea floor via the rigid, fixed position of the support structure 18.

In the illustrated embodiment, the support assembly 42 includes a lock 74 (e.g., one or more locking dogs, locking rings, fasteners, locking screws, clamps, collet segments, or the like) that is configured to couple the support assembly 42 to the support structure 18. The lock 74 (e.g., 1, 2, 3, 4, 5, 6, 7, 8, 9, 10, or more locks 74) is configured to move between an unlocked position (e.g., radially expanded position), which enables the support assembly 42 and the lock 74 to move into place about the support structure 18, and a locked position (e.g., radially contracted position), which blocks movement of the support assembly 42 relative to the support structure 18. In some embodiments, at least a portion of the lock 74 may contact and/or exert a radially-inward force on a side wall 78 (e.g., outer wall, annular wall, or radially-outer wall) of the support structure 18 when the lock 74 is in the locked position.

In some embodiments, the lock 74 may be actuated or driven from the unlocked position to the locked positioned via one or more actuators 76 (e.g., handle, pin, tool interface, mechanical actuator, hydraulic actuator, pneumatic actuator, electrical actuator, or the like). For example, in some embodiments, the one or more actuators 76 may be pushed radially-inwardly or rotated to move radially-inwardly along a threaded interface to drive the lock 74 into the locked position. In the illustrated embodiment, multiple actuators 76 (e.g., 1, 2, 3, 4, 5, 6, 7, 8, 9, 10, or more actuators) are positioned circumferentially about the support assembly 42. In some embodiments, the one or more actuators 76 may be operated by a remotely operated vehicle (ROV) and/or an autonomously operated vehicle (AOV). In some embodiments, the support assembly 42 may be supported by and positioned (e.g., lowered) about the support structure 18 via the ROV or AOV, and then locked into place via operation of the actuator 76 by the ROV or AOV. In some embodiments, the support assembly 42 may have a weight (e.g., be self-weighted) that maintains its position about the support structure 18, in addition to or in lieu of the lock 74.

In the illustrated embodiment, the support assembly 42 includes a frame 80 (e.g., upper housing or annular housing) that extends axially from the cap 70. In the illustrated embodiment, the frame 80 is coupled to the cap 70 via fasteners 82 (e.g., threaded fasteners, such as bolts) spaced circumferentially about the frame 80. However, in some embodiments, the frame 80 and the cap 70 may be a one-piece structure and may be integrally formed with one another. As shown, the frame 80 is generally annular and includes a bore 84 defined by a side wall 86 (e.g., outer wall, annular wall, or radially-outer wall). As shown, the side wall 86 of the frame 80 extends between the cap 70 and an axially-facing wall 88 (e.g., top wall or upper wall) of the support assembly 42, and the side wall 86 of the frame 80 includes an opening 90 (e.g., hole) to enable the pipe 50 to extend into the bore 84.

Figure 4:
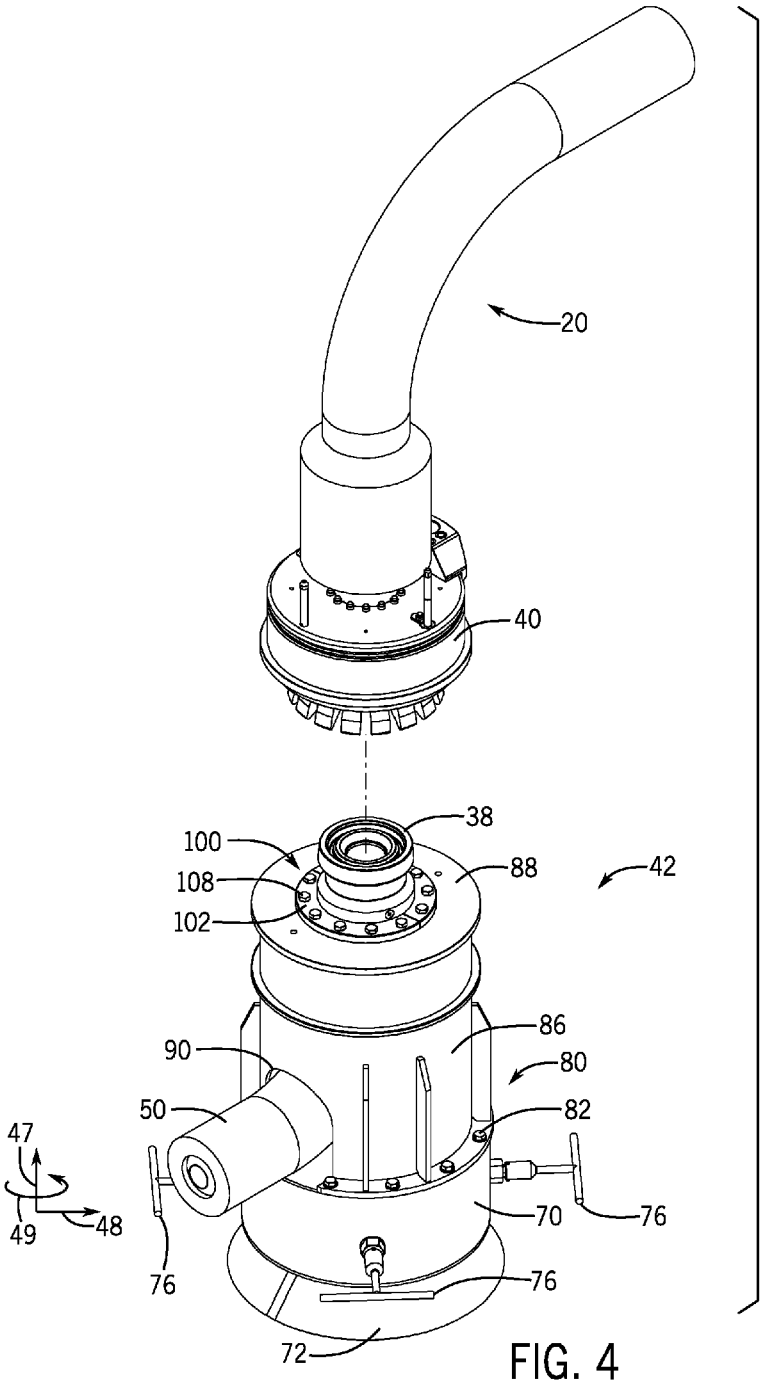
FIG. 4 is a perspective view of the support assembly of the extender jumper of FIG. 3, in accordance with one or more embodiments of the present disclosure.

In the illustrated embodiment, the pipe 50 includes the bending portion 58 having a segment 92 that extends in a first direction (e.g., along the lateral axis 48) through the opening 90 and a second axially-extending portion 94 that extends axially from the connector 38 and/or is coaxial with the connector 38 (e.g., with a central axis 96 of the connector 38). In the illustrated embodiment, the segment 92 and the second axially-extending portion 94 of the pipe 50 are joined by a turn 98 (e.g., bending or turning portion) positioned within the bore 84 of the support assembly 42. In some embodiments, the turn 98 may be formed by a continuous pipe section (e.g., bending pipe section), as shown in FIG. 4. In some embodiments, the turn 98 may be formed by a block elbow that joins two discrete segments of the pipe 50 to one another.

The connector 38 is supported by and coupled to the support assembly 42. As shown, the connector 38 extends through an opening 100 (e.g., hole) formed in the axially-facing wall 88 of the support assembly 42. In the illustrated embodiment, a ring 102 (e.g., split ring or annular ring) engages a recess 104 (e.g., annular recess) formed in a side wall 106 (e.g., outer wall, annular wall, or radially-outer wall) of the connector 38, and the ring 102 is coupled to the axially-facing wall 88 of the support assembly 42 via one or more fasteners 108 (e.g., threaded fasteners, such as bolts). As shown, the support assembly 42 may support the connector 38 such that the central axis 96 of the connector 38 is generally vertical, extends in the axial direction 47, is perpendicular to the axially-facing wall 88, and/or is perpendicular to the sea floor 46 when the support assembly 42 is coupled to the support structure 18. The connector 38 may be supported such that the connector 38 extends vertically above the support assembly 42 (e.g., along the axial axis 47 and relative to the sea floor 46). As discussed above, the connector 38 may be coupled to a corresponding connector, such as the connector 40 of the jumper 20 or the connector 26 of another extender jumper 14, as shown in FIG. 1. Thus, the support assembly 42 enables the extender jumper 14 to be coupled to and supported by the support structure 18, and also supports the connector 38 to facilitate coupling the extender jumper 14 to another component, such as another extender jumper 14, the jumper 20, or other subsea component.

FIG. 4 is a perspective view of the support assembly 42 of the extender jumper 14 of FIG. 3, in accordance with an embodiment of the present disclosure. In the illustrated embodiment, the support assembly 42 includes the cap 70 and the capture funnel 72, and multiple actuators 76 extend radially outward from the cap 70. The frame 80 is coupled to the cap 70 via fasteners 82, which are spaced circumferentially about the frame 80. The opening 90 is formed in the side wall 86 of the frame 80 to enable the pipe 50 to extend into the support assembly 42. The connector 38 extends through the opening 100 formed in the axially-facing surface 88 of the support assembly 42, and the connector 38 is coupled to the axially-facing surface 88 of the support assembly 42 via the ring 102 and the fasteners 108. As shown, the connector 38 is configured to mate with a corresponding connector (e.g., female collet connector), such as the illustrated connector 40 of the jumper 20. As noted above, the connector 38 may be configured to mate with any of a variety of connectors and/or components, such as the connector 26 of another extender jumper 14, shown in FIG. 1, or other flowline or subsea structure.

Figure 5:
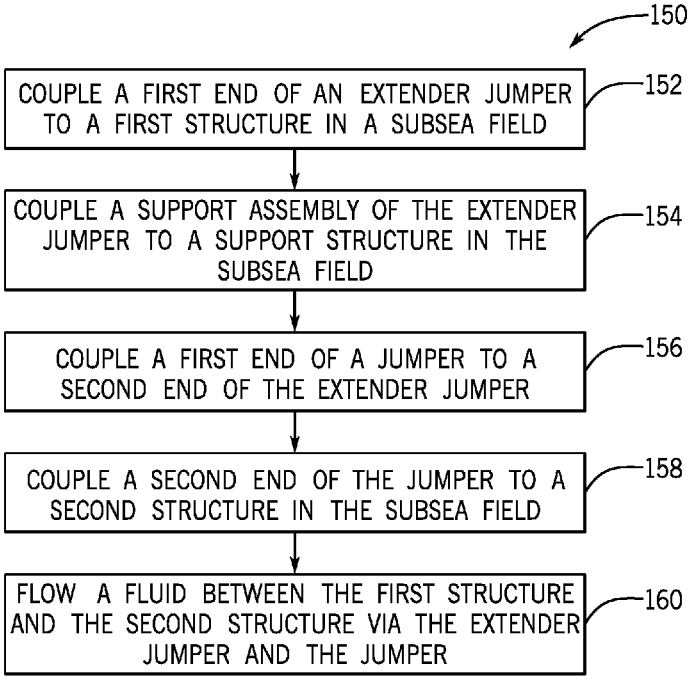
FIG. 5 is a flow diagram of a method of installing the extender jumper system of FIG. 1 within a subsea field, in accordance with one or more embodiments of the present disclosure.

FIG. 5 is a flow diagram of a method 150 of installing the extender jumper system 10 of FIG. 1 within the subsea field 12, in accordance with an embodiment of the present disclosure. The method 150 includes various steps represented by blocks. Although the flow chart illustrates the steps in a certain sequence, it should be understood that the steps may be performed in any suitable order and certain steps may be carried out simultaneously, where appropriate. As shown, in step 152, the first end 52 of the extender jumper 14 may be coupled to the first structure 16 within the subsea field 12. For example, in certain embodiments, the connector 26 of the extender jumper 14 may be coupled to the connector 28 of the first structure 16.

In step 154, the support assembly 42 of the extender jumper 14 may be coupled to the support structure 18 within the subsea field 12. In some embodiments, the support assembly 42 is coupled to the support structure 18 by positioning the cap 70 about the support structure 18 and driving the lock 74 into the locked position via the one or more actuators 76 (e.g., using the ROV or the AUV). As discussed above, the support structure 18 may be any of a variety of subsea structures, including, but not limited to, a manifold, a Christmas tree, a PLET, a PLEM, a pump, a HIPPS, a wellhead, a mud mat, a pile, a skid, or any other subsea equipment, component, or platform capable of support, any of which may be existing, currently operative, previously operative, currently inoperative, and/or abandoned. For example, the support structure 18 may include a temporarily or permanently inoperative wellhead, such as for example an abandoned wellhead. In some embodiments, the support assembly 42 may stabilize the extender jumper 14 and may also support the connector 38 at the second end 54 of the extender jumper 14 to facilitate coupling the extender jumper 14 to another jumper, such as another extender jumper 14 or the jumper 20.

In step 156, a first end of the jumper 20 is coupled to the second end 54 of the extender jumper 14. As discussed above, the connector 38 is positioned at the second end 54 of the extender jumper 14 and is supported by the support assembly 42. In certain embodiments, the connector 38 of the extender jumper 14 may be coupled to the connector 40 of the jumper 20. It should be understood that in certain embodiments, multiple extender jumpers 14 may be coupled to one another in series, and that the jumper 20 may be coupled to the last extender jumper 14 of the series of extender jumpers 14.

In step 158, a second end of the jumper 20 may be coupled to the second structure 22 within the subsea field 12. For example, in certain embodiments, the connector 32 of the jumper 20 may be coupled to the connector 34 of the second structure 22. In step 160, fluid may flow between the first structure 16 and the second structure 22 via the extender jumper 14 and the jumper 20 of the extender jumper system 10.

Figure 6:
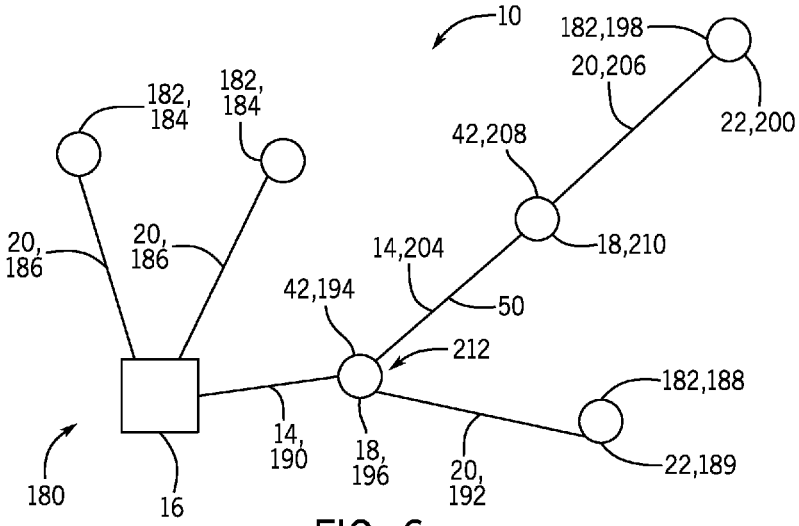
FIG. 6 is a schematic diagram of the extender jumper system of FIG. 1 in a subsea field having multiple wells, in accordance with one or more embodiments of the present disclosure.

FIG. 6 is a schematic diagram of the extender jumper system 10 in a subsea field 180 having multiple wells 182, in accordance with an embodiment of the present disclosure. As shown, one or more wells 182, 184 (e.g., production wells having respective Christmas trees positioned at the one or more wells 182, 184) may be coupled to the first structure 16 (e.g., a manifold) via respective jumpers 20, 186. In some embodiments, the one or more wells 182, 184 may be existing or previously drilled wells that are located a distance from the first structure 16 that can be traversed by respective jumpers 20, 186, for example.

In the illustrated embodiment, one well 182, 188 (e.g., the second structure 22, 189, such as a Christmas tree, positioned at the one well 182, 188) is coupled to the first structure 16 via a first extender jumper 14, 190 and a first jumper 20, 192, and the first extender jumper 14, 190 includes a first support assembly 42, 194 that is supported by a first support structure 18, 196. In the illustrated embodiment, one well 182, 198 (e.g., the second structure 22, 200, such as a Christmas tree, positioned at the one well 182, 198) is coupled to the first structure 16 via multiple extender jumpers 14 in series (e.g., the first extender jumper 14, 190, and a second extender jumper 14, 204) and a second jumper 20, 206. As shown, the second extender jumpers 14, 204 also include a second support assembly 42, 208 that is supported by a second support structure 18, 210. In the illustrated embodiment, a splitter 212 (e.g., t-coupling, y-coupling, manifold with multiple outlets) is provided proximate to the first support assembly 42, 194 of the first extender jumper 14, 190. For example, the splitter 212 may be provided along the pipe 50 of the second extender jumper 14, 204, proximate to first support assembly 42, 194 to enable multiple wells 182 to be coupled to the first structure 16 via the first extender jumper 14, 190.

By way of example, in some embodiments, the wells 182, 188, 198 may be relatively new wells at re-spud locations that are located a distance from the first structure 16 that may exceed an acceptable distance for a single jumper 20 or other typical jumpers, pipelines, or connectors, for example. In such cases, the extender jumper system 10 may enable the wells 182, 188, 198 to be coupled to the existing first structure 16. As noted above, the support structure 18 may include a manifold, a Christmas tree, a PLET, a PLEM, a pump, a HIPPS, a wellhead, a mud mat, a pile, a skid, or any other subsea equipment, component, or platform capable of support, any of which may be existing, currently operative, previously operative, currently inoperative, and/or abandoned. For example, the support structure 18 may include an inoperative wellhead, such as an abandoned wellhead. Thus, in some such cases, the extender jumper 10 may enable the wells 182, 188, 198 to be coupled to the existing first structure 16 using an existing support structure 18 as a rigid attachment point for the extender jumper system 10 without additional costs and/or time delays associated with constructing or installing a new platform or support structure.

Reference throughout this specification to "one embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

Although the present disclosure has been described with respect to specific details, it is not intended that such details should be regarded as limitations on the scope of the invention, except to the extent that they are included in the accompanying claims.

The invention claimed is:

1. An extender jumper system for a subsea field, comprising:

an extender jumper assembly, comprising:

a first flowline;

a first connector comprising a first central axis, wherein the first connector is positioned at a first end of the first flowline in an axially downward orientation to facilitate attachment between the first connector and a first subsea structure; and a second connector comprising a second central axis, wherein the second connector is positioned at a second end of the first flowline; and a support assembly configured to couple the extender jumper assembly to a support structure within the subsea field and to support the second connector in an axially upward orientation in which the second central axis is substantially parallel to the first central axis to facilitate attachment between the second connector and a corresponding connector of another extender jumper or a jumper.

2. The system of claim 1, wherein the support structure comprises one of a manifold, a Christmas tree, a pipeline end termination, a pipeline end manifold, a pump, a high integrity pressure protection system, a wellhead, a mud mat, a pile, or a skid.

3. The system of claim 1, comprising the support structure, wherein the support assembly is coupled to the support structure, and the support structure is an abandoned subsea structure fixed to a sea floor.

4. The system of claim 3, wherein the abandoned subsea structure is an abandoned wellhead.

5. The system of claim 4, wherein the support assembly comprises a cap configured to fit about a housing of the abandoned wellhead.

6. The system of claim 5, wherein the support assembly comprises a lock configured to move from an unlocked position to enable the cap to be positioned about the housing and a locked position in which the lock contacts the housing and blocks axial movement of the support assembly relative to the abandoned wellhead, and wherein the system comprises one or more actuators configured to drive the lock between the unlocked position and the locked position, and the one or more actuators extend radially from the support assembly to enable a remotely operated vehicle or an autonomously operated vehicle to interact with the one or more actuators.

7. The system of claim 1, wherein the first connector comprises a female collect connector and is configured to be coupled to a corresponding connector of the first subsea structure, and the corresponding connector comprises a male connector that is oriented axially upward and extends from the first subsea structure.

8. The system of claim 1, wherein the support assembly comprises a frame comprising a side wall and an axially-facing surface, and the second connector extends through a first opening formed in the axially-facing surface and the first flowline extends through a second opening in the side wall.

9. The system of claim 8, wherein the second connector is coupled to the axially-facing surface.

10. The system of claim 8, wherein the support assembly supports the second connector such that the second central axis of the second connector is generally perpendicular to the axially-facing surface to facilitate attachment between the second connector and the corresponding connector of the another extender jumper or the jumper.

11. The system of claim 1, wherein the support assembly is configured to support the second connector such that the second central axis of the second connector is generally perpendicular to the sea floor when the support assembly is coupled to the support structure to facilitate attachment between the second connector and the corresponding connector of the another extender jumper or the jumper.

12. The system of claim 1, wherein the first flowline comprises a first axially extending portion that is coaxial with and extends axially from the first connector, a second axially extending portion that is coaxial with and extends axially from the second connector, and a bending portion comprising segments extending in different directions that connects the first axially extending portion and the second axially extending portion to one another.

13. The system of claim 1, comprising the another extender jumper or the jumper, wherein the another extender jumper or the jumper comprises a second flowline, a third connector positioned at a respective first end of the second flowline and configured to couple to the second connector of the extender jumper assembly, and a fourth connector positioned at a respective second end of the second flowline and configured to couple to a second subsea structure.

14. A system, comprising:

a support assembly configured to support a jumper within a sub sea field, comprising:

a cap configured to be coupled to a support structure within the subsea field;

a frame extending from the cap and comprising a side wall and an axially-facing wall extending radially-inwardly from the side wall, wherein the axially-facing wall comprises a first opening to support a connector at one end of a flowline of the jumper and to enable the connector to pass through the axially-facing wall and the side wall comprises a second opening to enable the flowline to pass through the side wall; and a ring coupled to the axially-facing wall and configured to engage an annular recess formed in a radially-outer wall of the connector to couple the support assembly to the connector.

15. The system of claim 14, comprising the jumper, wherein the jumper comprises the flowline, the connector, and a first connector at another end of the flowline.

16. The system of claim 14, wherein the cap comprises a tapered annular funnel configured to guide the cap into position about the support structure.

17. A method, comprising:

coupling a first end of an extender jumper to a first structure within a subsea field;

coupling a second end of the extender jumper to another extender jumper or to a jumper; and coupling a support assembly of the extender jumper to an abandoned subsea structure fixed to a sea floor within the subsea field, wherein the support assembly supports the second end of the extender jumper to facilitate connection with the another extender jumper or the jumper, and wherein the abandoned subsea structure comprises an abandoned wellhead.

18. The method of claim 17, wherein the support assembly supports a connector at the second end of the extender jumper and maintains the connector in an axially-facing position with a central axis of the connector generally perpendicular to the sea floor to facilitate connection with the another extender jumper or the jumper.

19. The method of claim 17, comprising lowering the support assembly toward the abandoned subsea structure until a cap of the support assembly surrounds the abandoned subsea structure within the subsea field, and driving a lock of the support assembly from an unlocked position to a locked position to block axial movement of the support assembly relative to the abandoned subsea structure.

20. The method of claim 19, comprising using a remotely operated vehicle or an autonomously operated vehicle to operate one or more actuators to drive the lock from the unlocked position to the locked position.

21. The method of claim 17, wherein coupling the first end of the extender jumper to the first structure comprises coupling a first connector at the first end of the extender jumper to a second connector extending from the first structure, coupling the second end of the extender jumper to the another extender jumper or to the jumper comprises coupling a third connector at the second end of the extender jumper to a fourth connector extending from the another extender jumper or the jumper, the support assembly supports the third connector at the second end of the extender jumper and maintains the third connector in an axially-facing position with a central axis of the third connector generally perpendicular to the sea floor to facilitate connection with the fourth connector of the another extender jumper or the jumper.

* * * * *